United States Patent [19]

Namiki et al.

[11] 3,966,406

[45] June 29, 1976

[54] PROCESS FOR JET DYEING FIBROUS ARTICLES CONTAINING POLYESTER-TYPE SYNTHETIC FIBERS

[75] Inventors: Hiroshi Namiki, Nagaokakyo; Norihiro Minemura, Takatsuki; Takeo Kimura, both of Takatsuki; Shigeru Takahashi, Kaga, all of Japan

[73] Assignee: Teijin Limited, Osaka, Japan

[22] Filed: Sept. 4, 1974

[21] Appl. No.: 503,190

[30] Foreign Application Priority Data

Sept. 5, 1973 Japan ..... 48-99163
Sept. 18, 1973 Japan ..... 48-104503

[52] U.S. Cl. ..... 8/179; 8/151; 8/152

[51] Int. Cl.[2] ..... D06P 3/52

[58] Field of Search ..... 8/179, 151, 152

[56] References Cited

UNITED STATES PATENTS

| | | | |
|---|---|---|---|
| 3,042,480 | 7/1962 | Chipalkatti et al. | 8/151 |
| 3,418,065 | 12/1968 | Blount | 8/179 |
| 3,493,321 | 2/1970 | Inoue et al. | 8/151 |
| 3,497,311 | 2/1970 | Masuda | 8/152 |
| 3,510,251 | 5/1970 | Fujii et al. | 8/152 |
| 3,621,680 | 11/1971 | Masuda | 8/152 |
| 3,677,695 | 7/1972 | Peter | 8/152 |
| 3,751,224 | 8/1973 | Wackerle | 8/151 |
| 3,764,264 | 10/1973 | Bowers et al. | 8/179 |
| 3,802,840 | 4/1974 | Chiba et al. | 8/152 |
| 3,841,831 | 10/1974 | Miller | 8/179 |

*Primary Examiner*—M. J. Welsh
*Attorney, Agent, or Firm*—Sherman & Shalloway

[57] ABSTRACT

An improved jet dyeing process for fibrous articles containing polyester-type synthetic fibers which comprises heating the bath liquid while moving said fibrous article at a rate of 80 to 300 meters/min. in a bath containing no dye; adding a dye liquor at a rate of not more than 20 liters/sec. when the temperature of the dye bath has exceeded 110°C; and successively dyeing the fibrous article at a temperature of more than 110°C. while moving it at the above rate, and an apparatus suitable for practising aforesaid jet dyeing process.

14 Claims, 1 Drawing Figure

Figure 1:
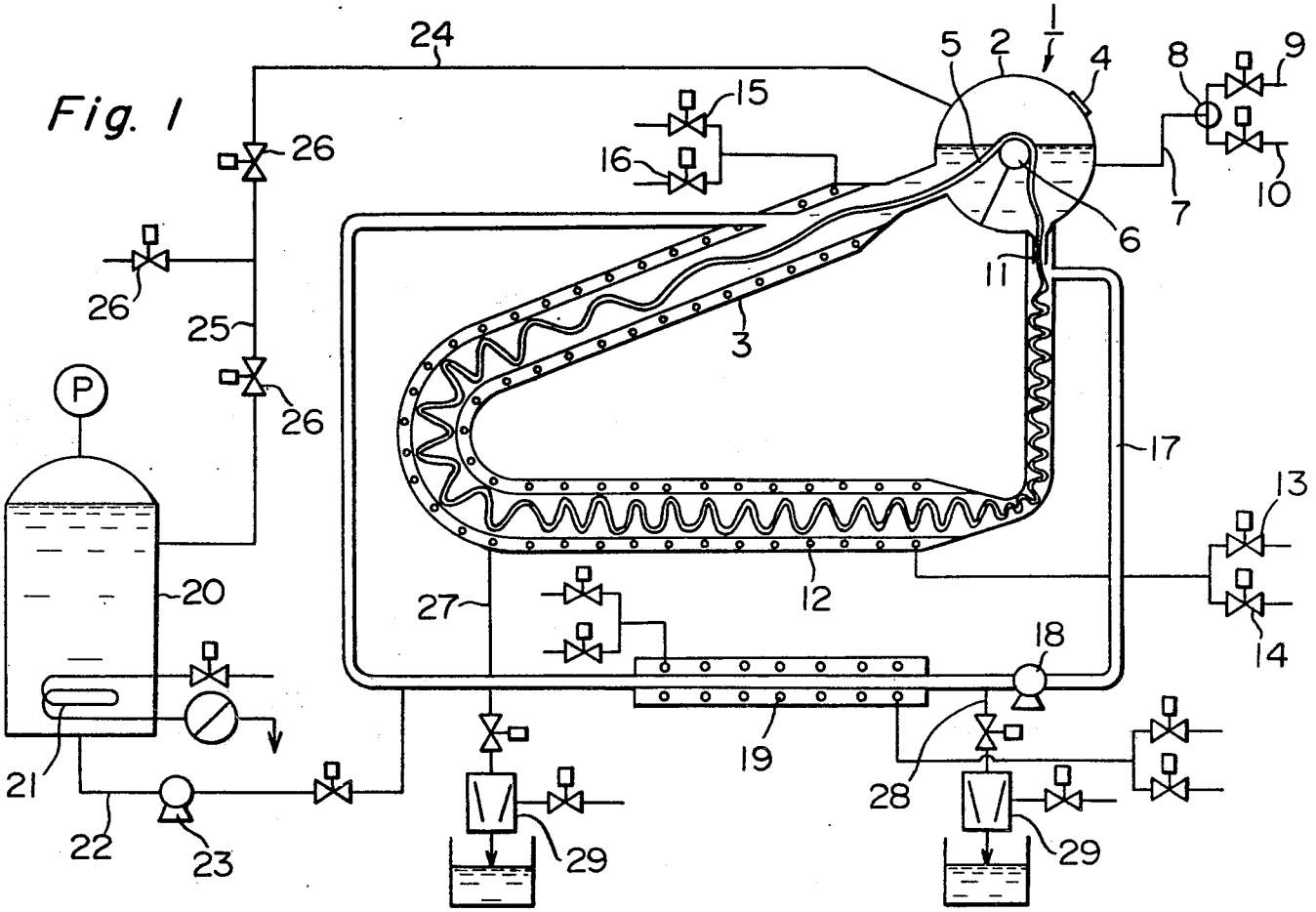

PROCESS FOR JET DYEING FIBROUS ARTICLES CONTAINING POLYESTER-TYPE SYNTHETIC FIBERS

This invention relates to a process and an apparatus for dyeing fibrous articles containing polyester-type synthetic fibers. More specifically, this invention relates to a process and an apparatus for dyeing fibrous articles containing polyester-type synthetic fibers using a jet of a dye liquor in accordance with the jet dyeing technique within short periods of time at high temperatures while moving a fibrous article containing polyester-type synthetic fibers in a dye bath.

Generally, fibrous products containing polyestertype synthetic fibers have previously been dyed by the jet dyeing method which involves adding dyes and auxiliaries at a temperature of as low as 40° to 60°C. to a bath of a dyeing machine loaded with a material to be dyed, raising the temperature to 120° to 140°C. while moving the material together with the dye liquor, and dyeing the material at this temperature for 60 to 90 minutes.

In this method, the polyester-type synthetic fibers begin to absorb the dyes gradually at a temperature of about 80°C. Thus, if heating rate is increased, the temperature distribution within the dyeing machine becomes non-uniform and causes dyeing irregularity. Accordingly, the control of the heating rate is of great importance. Usually, the heating rate is about 0.5°C./min. to 1°C./min.

Such a conventional jet dyeing method, however, has the defect that periods of as long as 50 to 90 minutes are required just for elevating the temperature of the liquor, and the entire dyeing process takes 3 hours or longer. It has, therefore, been strongly desired to develop a method for dyeing fibrous products containing polyester-type synthetic fibers uniformly within short periods of time.

Generally, in the dip-dyeing of polyester-type synthetic fibers, dyeing proceeds via the following steps:

1. Adsorption of dyes to the surfaces of the fibers;
2. Desorption and re-adsorption of the dyes from and to the surfaces of the fibers; and
3. Diffusion of the dyes into the fibers.

At a relatively low temperature of less than 100°C., the phenomena (1) and (2) occur, and at a temperature of more than 110°C., the diffusion of the dyes into the fibers is the main occurrence.

With this fact in mind, the inventors of the present application expected that if a dye bath which contains a fibrous article containing polyester-type synthetic fibers but no dye, is first heated to a temperature of 110°C. within a short period of time and the dyes are first added to the dye bath when the temperature of the bath exceeds 110°C., various difficulties such as the non-uniform temperature distribution in the dye bath caused by the excessively high heating rate and the consequent non-uniformity in adsorption, desorption, and readsorption of the dyes shown in (1) and (2) above which may cause dyeing irregularity could be avoided, and a marked shortening of the dyeing time could therefore be accomplished. On the basis of this conception, the inventors conducted various experiments.

In the course of the experiments, however, the inventors found that at a temperature of more than 110°C., the micro-Brownian motion of the polymer chain at a noncrystalline portion of the polyester-type synthetic fiber is very active, and the dyes diffuse very rapidly into the fibers, and therefore, the mere addition of dye or dye liquor to the bath results in the diffusion of the dyes into the fibers before the dyes are uniformly dispersed in the bath, and the dyed article exhibits marked dyeing irregularity.

Accordingly, the inventors of the present application made extensive investigations with a view to preventing the occurrence of such dyeing irregularity. As a result, they found that when a fibrous product containing polyestertype synthetic fibers is moved in a bath containing no dyes at a speed of 80 to 300 meters/min. and a dye liquor is added at a rate of not more than 20 liters/sec. when the temperature of the bath has exceeded 110°C., uniformly dyed fibrous products substantially free from dyeing irregularity can be obtained within very short periods of time.

Thus, according to this invention, a jet dyeing process for fibrous articles containing polyestertype synthetic fibers which comprises dyeing the fibrous article using a jet of a dye liquor while moving the article in a dye bath is provided. The bath liquid is heated while moving the fibrous article therein at a rate of 80 to 300 meters/min. while the bath does not contain any dye. When the temperature of the bath liquid has exceeded 110°C. a dye liquor is added to the bath at a rate of not more than 20 liters/sec., and the fibrous article is dyed at a temperature of more than 110°C. while moving it at the above rate.

Essentially, the dyeing method of this invention utilizes a so-called jet dyeing whereby a fibrous product is dyed using a jet of a dye liquor in a dye bath while being moved in it. The dyeing method of this invention is essentially characterized in that the rate of moving the fibrous product in the bath and the rate of adding the dye liquor are limited within the above-specified ranges in order to obtain a uniform temperature distribution of the bath and a uniform concentration distribution of the dyes within very short periods of time by immersing the fibrous article in a bath not containing dyes, then heating the bath, and then first adding the dyes to the bath when the temperature of the bath has exceeded 110°C.

The term "polyester-type synthetic fibers", as used in the present specification and the appended claims, denotes fibers formed from a synthetic polymer containing an ester linkage, and mainly refers to polyethylene terephthalate fibers but also includes synthetic fibers of modified polyesters resulting from the substitution of another copolymerizable monomer for a part of the acid component and/or alcohol component of a polyester or from the blending of a third component with a polyester, so-called cationic dyeable polyester-type synthetic fibers resulting from the substitution of 5-sulfoisophthalic acid for a part of terephthalic acid as an acid component of the polyester, anti-pilling polyester fibers resulting from the use of cyclohexane dimethanol as a modifying agent, easily dyeable polyester fibers having copolymerized therewith p-$\beta$-hydroxyethoxybenzoic acid glycol ester, methoxy polyethylene glycol or pentaerythritol, fire-retardant polyester fibers having copolymerized therewith a monomer containing halogen or phosphorus or having copolymerized therewith chlorendic acid or tetrabromophthalic anhydride replacing a part of terephthalic acid, and easily dyeable polyester fibers having blended therewith dioctyl phenyl polyethylene glycol or phenylphenol benzene-1,3-disulfonate. The polyester-type synthetic fibers used in this invention also include antipilling polyesters of low degrees of polymerization or physically modified polyester fibers such as those heattreated under relaxation.

Furthermore, the term "fibrous article containing polyester-type synthetic fibers", as used in the present application, include not only fibrous articles consisting solely of the polyester-type fibers, but also mix-spun, interwoven or interknitted fibrous articles prepared from the polyestertype synthetic fibers and other natural, regenerated or synthetic fibers. The fibrous article may be in the form of a knitted, woven or non-woven fabric.

Although the dyeing process in accordance with this invention can be performed using a dyeing apparatus which is especially improved for the dyeing process of this invention, various conventional types of jet dyeing machines by which fabrics can be dyed while being moved in a dye bath using a jet of a dye liquor can be employed. Examples of such apparatus include a jet-dyeing machine (Gaston County Dyeing Machine Co.), a circular jet-dyeing machine (Hisaka Works, Ltd.), "Uni-Ace" dyeing machine (Nippon Dyeing Machine Co.), HT dyeing machine "Loco-Overflow" (Hokuriku Chemical Machinery Co., Ltd.), "Masflow" installation (Masuda Manufacturing Co., Ltd.), and the like (see ITB Dyeing/Printing/Finishing 4/1971). Dyeing machines having a structure in which the material is dyed while it is almost completely immersed in the dye liquor, and particularly, the circular-type jet-dyeing machine, are especially suitable.

In the process of this invention, it is essential that the polyester fibrous article is moved in the bath at a rate of 80 to 300 meters/min., preferably 100 to 250 meters/min., more preferably 150 to 200 meters/min. At a rate slower than 80 meters/min., the temperature of the bath and the concentration of the dye cannot be made sufficiently uniform within short periods of time. On the other hand, if the rate of moving the fibrous article exceeds 300 meters/min., the disorder of the liquid flow of the bath becomes remarkable. In either case, uniform dyeing free from dyeing irregularity cannot be achieved. Furthermore, when the rate of moving the fibrous article exceeds 300 meters/min., an excessively high tension is exerted on the fibrous article, and this impairs the feel of the fibrous article. The optimum rate of moving the fibrous article can be determined by any one skilled in the art after a simple routine experiment according to the form of the fibrous article to be dyed, or the type of the dyes, etc.

The moving of the fibrous article can be accomplished by the flow of the dye liquor and a rotating reel provided within the dye bath. The flow of the dye liquor is accomplished by feeding it under pressure by means of a nozzle provided within the dye bath. The rate of moving the fibrous article can be controlled suitably be adjusting the rate of the flow of the dye liquor and the rotating speed of the rotating reel.

Heating of the bath liquid can be performed by suitable heating means, such as a heat-exchange device provided in the dye bath and/or a circulatory dye liquor path outside the dye bath. The rate of elevating the temperature of the bath liquid is not preferably restricted. According to the process of this invention, the temperature can be rapidly raised up to a temperature of 110°C., and this is significant advantage of the process of this invention.

Since in the process of this invention, the bath liquid and the fibrous article are circulated within the dye bath at a specific moving speed, the temperature distribution of the bath liquid can be rendered uniform easily and rapidly even if the heating rate of the bath is increased drastically. Thus, the time required for temperatures elevation can be markedly shortened by drastically raising the rate of temperature elevation.

It has been found that if a heat-exchanger is provided both within the dye bath and the dye liquor circulatory path outside the dye bath and the sum of the heat-conducting areas of the two heat-exchangers is adjusted to at least 30 $cm^2$, usually 40 to 60 $cm^2$, per liter of the volume of the dye bath, the temperature of the bath can be raised uniformly up to the desired point within short periods of time.

Thus, according to the process of this invention, the elevation of the temperature of the bath from room temperature to an optimum dyeing temperature above 110°C. can be accomplished usually within a short time of 10 to 20 minutes.

It is not altogether necessary that the bath is at room temperature when loading the fibrous article. But it is advantageous for shortening the time of temperature elevation to load the fibrous article after placing prewarmed water, preferably water heated to not more than 80°C., in the dye bath.

In this manner, the bath liquid is heated rapidly within short periods of time to a temperature of at least 110°C. which is suitable for dyeing. Another feature of this invention is that the addition of dye to the dye bath is begun when the temperature of the bath liquid has reached at least 110°C. which temperature is suitable for dyeing.

The dye is fed into the dye bath generally from a dye bath preparation tank in the form of an aqueous solution or aqueous dispersion. The concentration of the dyes in the tank is not critical, but can be varied over a wide range according to such factors as the type of the dyes, the temperature of the bath, or the type of the fibrous article. Usually, it is 1 g/liter to 100 g/liter.

It is important that the rate of adding the dye liquor to the dye bath is less than 20 liters/sec. Even if the rate of moving the fibrous article is adjusted to 40–300 meters/min., it is difficult to render the concentration of the dye in the dye bath uniform rapidly. Especially suitable rates of addition are within the range of 1 to 10 liters/sec. The concentration of the dye in the dye bath is not critical, but can be varied over a wide range. For example, however, the concentration can be 0.001 to 5% o.w.f.

The dye liquor is added from a dye bath preparation tank containing an aqueous solution or dispersion of the dyes by conventional means such as a circulating pump or pressure pump. Desirably, the temperature of the dye liquor to be added is approximately the same as that of the bath liquid, but can usually be 40° to 130°C.

Any dyes that are usually used to dye polyester-type synthetic fibers can be used in the process of this invention. Examples are disperse dyes, cationic dyes, acid dyes, or metal containing dyes.

The goods-to-liquor ratio in the dye bath can be varied over a wide range according to the type of the dyes, or the type of the fibrous product. But generally, it is 1:10 to 1:50, preferably 1:20 to 1:40.

Dyeing is carried out by adding the dye liquor at the above-specified rate while moving the fibrous article at the above-specified rate. The temperature at the time of dyeing is at least 110°C., and up to 140°C., preferably 120° to 135°C. At these temperatures, dyeing is completed usually in 10 to 60 minutes.

In order to facilitate the dispersion and migration of the dyes, auxiliaries such as a polyoxyethylene alkyl ester or ether, or a Tamol-type anionic surface active agent can be added to the bath liquor or the dye liquor. Advantageously, such an assistant is added to the dye bath before the bath temperature reaches 110°C, preferably 30°-80°C., and this ensures more even dyeing.

In order to prevent the decomposition of the dye during the dyeing operation, it is preferred to add an acid such acetic acid to maintain the pH of the bath liquid at 4 to 6, as is usually practised.

Thus, according to the process of this invention, uniform dyeings free from dyeing irregularity can be obtained within very short periods of time without using any special device.

As previously stated, the process of this invention can be performed satisfactorily using known liquid-flow dyeing machines. However, according to another aspect of this invention, there is provided an especially improved dyeing apparatus suitable for practice of the process of this invention.

Thus, according to this invention, there is provided a jet dyeing apparatus comprising a. a dyeing tank including an opening for loading and unloading a fibrous article, a liquid feeding and discharging system, a circularoty dye liquor flow path capable of moving the fibrous article, and means for moving the fibrous article along said flow path, b. a first heat-exchanger provided at at least a part of said circulatory dye liquor flow path, c. an exterior dye liquor circulatory path extending from one end of said circulatory dye liquor flow path to the other end, d. a second heat exchanger provided at at least a part of the exterior dye liquor circulatory flow path, and e. a dye bath preparation tank for feeding a dye liquor into said dye bath tank, the sum of the heat-conducting areas of said first heat exchanger and said second heat-exchanger being at least 30 $cm^2$ per liter of the volume of said dyeing tank.

The improved jet dyeing apparatus of this invention will be described in greater detail by reference to the accompanying FIG. 1 which is a schematic view of the jet dyeing apparatus of this invention.

Referring to FIG. 1, a jet dyeing tank 1 consists of a main beck 2 and a dye liquor circulatory path 3 capable of moving a fibrous article to be dyed. The circulatory path 3 is preferably a U-tube as shown in the drawing. The main beck 2 includes an opening 4 at its upper part for loading and unloading the fibrous article, and at its central part, a rotating reel 6 for supporting the fibrous article 5 and controlling the rate of the fibrous article. Furthermore, the main beck 2 includes a liquid supply path 7 for supplying water to the dyeing tank 1. The liquid feed path 7 is equipped with a steam mixer 8 so that water fed from a conduit 9 is properly mixed with steam or hot water fed from a hot water source (not shown) from a conduit 10. By this contrivance, there is obtained an effect of rapidly elevating the temperature of the bath liquid.

On the other hand, the dye liquor circulatory path 3 is for the purpose of moving the dye liquor and the fibrous article 5 at certain rates therethrough. One end 11 of the path is narrowed in a nozzle shape or a nozzle is provided inside the path 3 so as to impart a driving force to the dye liquor and the fibrous article. At least a part of the inner circumferential surface of the circulatory path 3 is covered with a first heat exchanger 12 to heat the dye liquor. The heat exchanger 12 can be of any desired type such as a hose, double jacket or plate-type heat-exchanger. The heat exchanger includes a steam inlet valve 13, a drain valve 15, a cooling water inlet valve 14 and a cooling water outlet valve 16 so as to pass steam or cooling water to the heat-exchanger 12.

The dye liquor circulating path 3 includes an exterior dye liquor circulating path 17 extending from one end 11 to the other end, through which the dye liquor is forcibly circulated by means of a dye liquor circulating pump 18 to control the rate of moving the fibrous article and the rate of moving the bath liquid in the circulatory path 3 at the same time. A second heat-exchanger 19 is provided at at least a part of the exterior circulatory path 17 to heat the bath liquid and the dye liquor. In the same manner as the heat-exchanger 12, the heat-exchanger 19 can include a steam inlet valve, a drain valve, a cooling water inlet valve, and a cooling water outlet valve.

The critical feature of the apparatus of this invention is that the sum total of the heat-conducting areas of the heat exchangers 12 and 19 is at least 30 $cm^2$, preferably 40 to 60 $cm^2$, per liter of the volume of the dyeing tank 1. This structure ensures the heating of the dye bath uniformly within short periods of time.

A dye preparation tank 20 is attached to the dyeing tank 1 so as to feed the dyes to the dyeing tank. The dye preparation tank 20 is equipped with a heater 21 to heat the dye liquor in the tank. This heater 21 can be an ordinary heating means such as an electric heater or steam heater. This heater makes it possible to heat the dye liquor within the tank to almost the dyeing temperature. The dye liquor passes through a conduit 22 and is fed preferably to the exterior dye liquor circulating path 17 by means of a pump 23.

Hydrostatic pressure can be applied to the main beck 2 and the dye preparation tank 20 by means of conduits 24 and 25 respectively through a compressed air valve 26 from a compressed air supply source (not shown). This can lead to the prevention from the cavitation of the dye liquor circulating pump 18.

A high temperature high pressure liquid discharge device 29 can be attached to the dyeing tank 1, preferably its dye liquor circulatory path 3, and also to liquid discharge conduits 27 and 28 optionally fitted to the exterior dye liquor circulatory path 17. The high temperature high pressure liquid discharge device can, for example, be an injector method using water as a power source. This makes it possible to discharge the dye liquor at a temperature above 100°C., and the time required for cooling the dye bath can be shortened.

A more specific description of the dyeing of a fibrous article using the apparatus of this invention is as follows:

First, warm water at 80°C. is injected into the dyeing tank 1 by means of the steam mixer 8 in an amount of 1800 liters as against the total volume of 2000 liters. The hot water supply source (not shown) may be of the steam mixer type silencer-type, or heat-exchanging type. Then, the dye liquid circulating pump 18 is operated, the speed of introducing the fibrous article into the tank is adjusted by means of the nozzle 11, and a required amount of a fibrous article 5 of polyester-type synthetic fibers (for example, a fabric) is placed in the dyeing tank 1 from the opening 4. Both ends of the fibrous article are sewn together, and by adjusting the nozzle 11 the rate of movement of the fibrous article is adjusted to 30 to 300 meters/min. Then, using a compressed air valve 26, static pressure is applied to the dyeing tank 1, and steam is passed into the heat exchangers 12 and 19 after opening of the inlet valve 13 and the drain valve 15.

Thus, the temperature inside the dyeing tank is elevated to at least 110°C., preferably up to 130°C. in about 15 minutes.

On the other hand, required amounts of dyes and auxiliaries are dissolved or dispersed in water in the dye preparation tank 20, heated to 100°C. by heater 21, and then poured into the dyeing tank 1 maintained preferably at 130°C. from the conduit 22 and the exterior dye liquor circulating path 17 by operating the pump 23. Furthermore, warm water is added to adjust the total liquid volume in the dye bath tank to 2000 liters. At this temperature, dyeing is performed for about 50 minutes, and through the liquid discharge conduits 27 and 28, the dye liquor is discharged at a high temperature by means of the high temperature liquid discharging device 29.

At the same time, the inlet valve 13 and the outlet valve 15 are closed, and the cooling water inlet valve 14 and the cooling water outlet valve 16 are opened. Cooling water is passed through the heat exchanger 12 within the dyeing tank. The fibrous article withdrawn from the dyeing tank is post-treated and washed in a customary manner. By this operation, an even dyeing is obtained. The time required for this dyeing operation is about 70 minutes which is a drastic shortening as compared with the dyeing time of conventional apparatus which is more than 140 minutes.

Furthermore, since in the present invention, the sum total of the heat-conducting areas of the first and second heat exchangers is as large as at least 30 $cm^2$/liter of the volume of the dyeing tank, the temperature of the dye liquid can be elevated rapidly at a rate of about 5°C/min., and thus, as compared with the conventional dyeing machines, the elevating time is markedly shortened. In the cooling step, the dye liquor and the dyeing tank can be rapidly cooled by passing cold water through the heat exchanger provided in the dyeing tank. At the same time, the dye liquor is drained at a high temperature and a high pressure to prevent the occurrence of entanglement or creases of the fibrous article which may be caused by the violent motion of the fibrous article by the abrupt evaporation owing to the residual heat of the dyeing tank or the fibrous article.

Another advantage of the apparatus of this invention is that by the provision of a hot water feeding device within the water feeding path, water heated to a required temperature can be fed to the dyeing machine, and the heating time can be drastically shortened as compared with the conventional method in which cold water is directly heated in the dyeing machine.

Still another advantage of this invention is that by providing a high temperature high pressure liquid discharging device in the liquid discharge path, the dye liquor can be discharged outside the dye bath tank at a temperature of more than 100°C., and the time required for cooling the dye bath can be shortened.

When rapid temperature elevation and rapid cooling are performed by the jet dyeing machine of this invention while increasing the number of contacts between the material to be dyed and the dye liquor, the temperature distribution and the concentration of the dyes can be rapidly rendered uniform in the dye bath. Consequently, the resulting dyeings are substantially free from dyeing irregularity or creases and the dyeing time can be shortened remarkably compared with the conventional method.

The following examples illustrate the present invention more specifically.

EXAMPLE 1

Twelve pieces (60 Kg) of woven fabrics made of polyethylene terephthalate fibers ("TETORON", registered trademark, a product of Teijin Limited) which had been relaxed, scoured and set were loaded in a dyeing tank of a circular I-type dyeing machine (a product of Hisaka Works, Ltd.) having a capacity of about 2400 liters, and 2300 liters of water and 0.4 g/liter of polyoxyethylene (10 mol adduct) lauryl ester, 0.5 g/liter of Disper TL (a Tamol-type surface active agent, a product of Meisei Chemical Co., Ltd.) and 0.2 g/liter of glacial acetic acid were added. The flow rate of the liquid in the U-tube of the dyeing machine was then adjusted by the nozzle pressure so as to set the fabric speed at 180 meters/min. The temperature of the bath was then elevated from 30°C. to 130°C. over the course of about 10 minutes using a heat exchanger and a coil for temperature elevation.

Separately, a dye liquor of the following formulation was prepared.

| | |
|---|---|
| Latyl Blue FLW (C.I. 60767) (a product of Du Pont) | 0.6 Kg |
| Sumikaron Yellow 5G (C.I. 12790) (a product of Sumitomo Chemical Co., Ltd.) | 0.6 Kg |
| Water | 70 liters |

The dye liquor was fed into the bath of the dyeing machine held at 130°C. by means of a pressure pump at the rate shown in Table 1, and dyeing was performed for 60 minutes. Then, the dye bath was cooled to about 90°C., and the liquid was discharged. The time required for the dyeing step only was 95 minutes, which was shorter by about 75 minutes than that required in the conventional method.

Then, the dyed fabrics were subjected to reduction clearing at 80°C. for 20 minutes using a liquid composed of 2 g/liter of hydrosulfite, 2 g/liter of sodium hydroxide, 2 g/liter of "Amirazine" (a polyoxyethylene alkylamine type surfactant a product of Daiichi Kogyo K.K.), and 2400 liters of water.

With varying rates of adding the dye liquor, the level dyeing properties of the dyed fabrics were as shown in Table 1. It is clear from Table 1 that if the rate of adding the dye liquor is within the range specified in the present invention, the level dyeing properties are superior.

Table 1

| | Rate of addition (liters/sec.) | Level dyeing properties |
|---|---|---|
| Present invention | 1 | very good |
| Present invention | 5 | very good |
| Present invention | 15 | good without dyeing specks |
| Comparison | 25 | poor with marked |

Table 1-continued

| | Rate of addition (liters/sec.) | Level dyeing properties |
|---|---|---|
| | | dyeing specks |

EXAMPLE 2

Woven fabrics of polyethylene terephthalate fibers ("TETORON") were dyed in the same way as in Example 1 except that the rate of adding the dye liquor was fixed at 5 liters/sec. and the rate of flowing the fabrics was changed as shown in Table 2. The results are shown in Table 2.

Table 2

| | Rate of flowing fabrics (m/min.) | Level dyeing properties |
|---|---|---|
| Present invention | 80 | good with dyeing irregularity |
| Present invention | 100 | very good |
| Present invention | 180 | very good |
| Present invention | 250 | very good |
| Comparison | 40 | poor with marked dyeing irregularity |

COMPARATIVE EXAMPLE 1

Example 1 was repeated except that the dye liquor was added at 30°C., and the temperature of the bath was raised from 30°C. to 130°C. over the course of about 10 minutes. Dyeing irregularity with rope mark occurred in the dyed fabrics.

COMPARATIVE EXAMPLE 2

Example 1 was repeated except that the dye liquor was added at 80°C., and the temperature of the bath was elevated from 80°C. to 130°C. in the course of about 5 minutes. Dyeing irregularity with rope mark occurred in the dyed fabrics.

What we claim is:

1. In a jet dyeing process for dyeing fibrous articles containing polyester-type synthetic fibers by adding a jet of a dye liquor to a liquid bath containing a fibrous article moving therein, the improvement which comprises, a. moving the fibrous article in a liquid bath in a dyeing tank at a rate, relative to said dyeing tank, of 80 to 300 meters per minute while the liquid bath is at a temperature of no more than 80°C. and does not contain any dye, b. elevating the temperature of the liquid bath in the dyeing tank to at least 110°C., while the fibrous article is moving therein, and c. adding a dye liquor containing dye in an amount of 1 gram per liter to 100 grams per liter to said liquid bath at a rate of not more than 20 liters per second after the temperature of said liquid bath reaches at least 100°C. to form a dye bath in said dyeing tank of at least 110°C., said dye bath having a dye concentration of 0.001 to 5% based on the weight of the fibrous article in said dye bath, while continuing to move said fibrous article in said dye bath at said rate of 80 to 300 meters per minute, relative to said dyeing tank until said fibrous article is dyed.

2. The process of claim 1 wherein the rate of moving the fibrous article is 100 to 250 meters/min.

3. The process of claim 1 wherein in step (*c*) the dye liquor is added to the liquid bath at a rate of 1 to 10 liters/sec.

4. The process of claim 1 wherein the weight ratio of said fibrous article to said dye liquor in said dye bath is 1:10 to 1:50.

5. The process of claim 1 wherein the dyeing is carried out at a temperature of 110° to 140°C.

6. The process of claim 1 wherein said dyeing is carried out for 10 to 60 minutes.

7. The process of claim 6 wherein the dyeing is carried out at a temperature of 120° to 135°C.

8. The process of claim 1 wherein the heating of the dye bath is performed by means of heat exchangers provided in said dye bath and in a dye liquor circulating path outside the dyeing tank, the sum total of the heat-conducting areas of the two heat exchangers being at least 30 $cm^2$ per liter of the volume of the dyeing tank.

9. The process of claim 8 wherein the sum total of the heat-conducting areas of the two heat exchangers is from 40 to 60 $cm^2$ per liter of the volume of the dyeing tank.

10. The process of claim 1 wherein the dyeing is carried out using a jet-dyeing machine.

11. The process of claim 1 wherein the weight ratio of the fibrous article to the dye liquor in the dye bath is 1:20 to 1:40.

12. The process of claim 1 wherein the liquid bath of step (a) is at a temperature of from room temperature to 80°C.

13. The process of claim 1 wherein, in step (*c*), said dye liquor is at a temperature of 40°C. to 130°C. when added to the liquid bath in the dyeing tank.

14. The process of claim 1 wherein, in step (*c*), the dye liquor added to the liquid bath in the dyeing tank is at approximately the same temperature as the liquid bath temperature.

* * * * *